US005299385A

United States Patent [19]

McConnell

[11] Patent Number: 5,299,385

[45] Date of Patent: Apr. 5, 1994

[54] DETENTION CELL LOCKING SYSTEM

[75] Inventor: Lloyd McConnell, Addison, Tex.

[73] Assignee: Glitsch, Inc., Dallas, Tex.

[21] Appl. No.: 959,062

[22] Filed: Oct. 9, 1992

[51] Int. Cl.[5] ..... E05B 47/06

[52] U.S. Cl. ..... 49/18; 49/26; 49/140; 49/506

[58] Field of Search ..... 49/18, 15, 16, 17, 19, 49/20, 506, 139, 140, 26

[56] References Cited

U.S. PATENT DOCUMENTS

| | | | |
|---|---|---|---|
| 584,753 | 6/1897 | York . | |
| 1,125,754 | 1/1915 | Sohn . | |
| 1,300,782 | 4/1919 | Ryan . | |
| 1,990,166 | 2/1935 | Brodsky . | |
| 2,185,175 | 1/1940 | Adam . | |
| 2,837,182 | 6/1958 | White . | |
| 3,571,974 | 3/1971 | Browning et al. . | |
| 3,866,354 | 2/1975 | Butt . | |
| 4,190,985 | 3/1980 | Richards et al. . | |
| 4,723,373 | 2/1988 | Jump | 49/18 |
| 4,897,959 | 2/1990 | Worden | 49/18 |
| 4,982,528 | 1/1991 | Michel | 49/18 X |

*Primary Examiner*—Philip C. Kannan

*Attorney, Agent, or Firm*—Johnson & Gibbs

[57] ABSTRACT

A detention cell locking system affording improved securement and reliability in the locking network of multiple detention cell doors. Mechanical actuation linkages are interconnected for motion responsive to either select manual, mechanical, or electrical signals actuating a DC motor drive. The locking mechanism incorporates an elongate toggle plate mounted to a carriage plate and a pair of cell door support rollers forming part of a mechanical locking system. The toggle plate assembly on the carriage plate permits a turning moment to be generated for lost motion actuation which effects locking and unlocking of the detention cell doors. A control network determines the length of time that the DC motor is electrically actuated and disengages the power to the motor during manual mechanical actuation.

26 Claims, 9 Drawing Sheets

DETENTION CELL LOCKING SYSTEM

BACKGROUND OF THE INVENTION

1. Field of the Invention

The present invention relates to detention cell locking systems and, more particularly, to detention cell systems utilizing electro-mechanical operational networks, lost motion linkages and control networks therefor.

2. History of the Prior Art

Locking systems for detention cells used in jails, prisons and the like date back into technological antiquity. In early times, the primary import of such locking systems was simply securement of individual cell doors. Today, the criteria have expanded considerably with large detention institutions and multiple cell banks operated from a single control center.

Conventional detention cell locking systems typically utilize one or more complex electro-mechanical networks that facilitate the simultaneous locking and unlocking of multiple detention cell doors. A myriad of securement and safety considerations are then factored in, wherein the system permits emergency use in the event of an electrical power failure. Select manual operation thus incorporates mechanical overrides of the locking system for use by guards in the event of various emergencies. However, these systems must also include means for preventing either the disablement or actuation by those individuals being detained behind the detention cell doors. Such criteria have been mandated by the increase in jail and prison populations necessitating more jail cells as well as methods and apparatus for the control and operation thereof.

It is common place in the design of a detention cell door to incorporate mechanical linkage which is remotely actuatable by servo drive systems. The servo drive system generally imparts an engagement or disengagement action to a variety of looking elements within a single detention cell door For example, the bottom of the detention cell door may be simultaneously locked and unlocked with the top of the door through a vertical locking bar housed within the detention cell door frame. The mechanical linkage operating the locking bar and locking the upper part of the door are usually disposed in the upper cell door region or transom. It is typical to utilize a track upon which a door carriage moves. A typical detention cell door carriage and/or track comprises heavy metal elements from which the detention cell door depends with a series of rollers therebetween.

By way of example, U.S. Pat. No. 3,866,354 is a 1975 patent illustrating a combination electrical and mechanical security system incorporating a "lost motion" linkage. The cell door shown in this patent is also remotely controlled in an electrical mode. In the event of an electrical power failure, the security system may also be operated through a mechanical linkage to permit opening or closing of the cell doors. These are the very criteria described above that are necessary in conventional detention cell systems. The actual mechanism set forth and shown in this reference includes lost motion slots which permit the carriage assembly to travel through the lost motion region for locking and unlocking.

Yet another detention cell door looking system is seen in U.S. Pat. No. 3,571,974. This 1971 reference teaches a mechanical linkage also actuated by an electric motor utilizing a rack and pinion drive. A locking slide bar is shown to be movable at each end of travel of the carriage to bias a pivotable cell door lock bar carried by the carriage. The look bar is moved into locking engagement with the door upon arrival of the door at either of a fully open or fully closed position. Cams are provided to move the lock bar upon initiation of the driving force. The use of rack and pinion drives as well as cam actuated locking systems are well known in the prior art and are commonly utilized in mechanical linkages outside the detention cell door industry. The utilization of such linkages within the detention cell door industry is consistent with established mechanical design parameters. Likewise, the utilization of electric drive motors in conjunction therewith is conventional.

Yet another cam actuated, look control mechanism is seen in U.S. Pat. No. 4,190,985. This 1980 patent also teaches a door locking assembly utilizing a vertical drop bar in the door jam with catches for engaging and locking the door at preferably two locations. As shown therein, the bar may be lifted by three different means: by a remotely actuatable motor, by rotating a key in a key cylinder, and by an emergency release mechanism including a manually slidable linkage member disposed atop the door frame It may be seen that it is conventional in such detention cell looking assemblies to utilize multiple, backup operational systems in conjunction with the remotely actuatable system, motorized eccentrically mounted cams and double locking and vertical drop bars. Notwithstanding the above, improvements in the detention cell industry are necessary for purposes of utilizing innovations in both mechanical and electrical system technology as well as updating actuation linkage designs to further enhance reliability, safety, and effectiveness.

It would thus be an advantage therefore to provide a detention cell locking system utilizing an improved electro-mechanical drive assembly having improved reliability, efficiency, and safety aspects. The present invention provides such a system by utilizing a pair of interacting toggle plates in conjunction with an electrically driven, horizontal bar drive facilitating not only remote electrical actuation but also remote and local mechanical actuation.

SUMMARY OF THE INVENTION

The present invention relates to detention cell locking systems More particularly, one aspect of the present invention includes a detention cell locking system incorporating a pair of interacting toggle plates pivotally mounted to a drive carriage suspending the detention cell door from a support track housed in a transom thereabove and the electrical control system therefor. The toggle plates are actuated by a rectilinearly translatable block driven by rotation of a shaft extending therethrough, which block imparts select movement to the toggle plates and the select lost motion thereof, during the locking and unlocking operation therewith.

In another aspect, the present invention comprises an improved detention cell locking system of the type utilizing a detention cell door with an upper supporting carriage facilitating the movement thereof between locked and unlocked positions. The carriage is actuated in one mode by an electric drive motor and imparts locking actuation to at least one vertical locking bar and a second carriage locking member. The improvement comprises a first large and second small toggle plate mounted to the drive carriage adapted for pivotal engagement one with the other and lost motion in association therewith for both locking and unlocking the first mechanical linkage and the vertical looking bar.

In yet another aspect, the above-described invention includes means for controlling the movement of the vertical locking bar with first and second cam levers disposed on opposite ends of the carriage track. The cam levers are connected by a shaft having a rectilinear cam region therein. The vertical locking bar is coupled to the rectilinear cam region by a cam follower and the levers are adapted for engaging the carriage assembly in the vicinity of the large and small toggle plates for the actuation thereof in association with a lost motion actuation.

In a further aspect, the above-described invention includes the large toggle plate being constructed with a drive slot in the upper region thereof. The drive slot receives the small toggle plate therein in a pivotal engagement therewith. The small and large toggle plates are pivotally mounted to the supporting carriage to produce select pivotal actuation in response to rectilinear movement thereof.

In yet a further aspect, the above-described invention includes an electric drive assembly comprising a drive motor and a timer circuit coupled in series to the motor with at least one door position sensor for controlling the duration of operation of the motor and movement of the cell door. The electric drive assembly may include a first door position sensor detecting the open position of the cell door and a second door position sensor detecting the closed position of the cell door. The electric drive assembly may also incorporate first and second actuation relays coupled to the drive motor and to the timer circuit for controlling the power to, and the direction of operation of, the drive motor. A resistor may be connected by the first relay to a position shorting the motor and forming a dynamic brake therefor. The first relay may then be adapted for disconnecting the dynamic braking resistor upon actuation thereof.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1A:
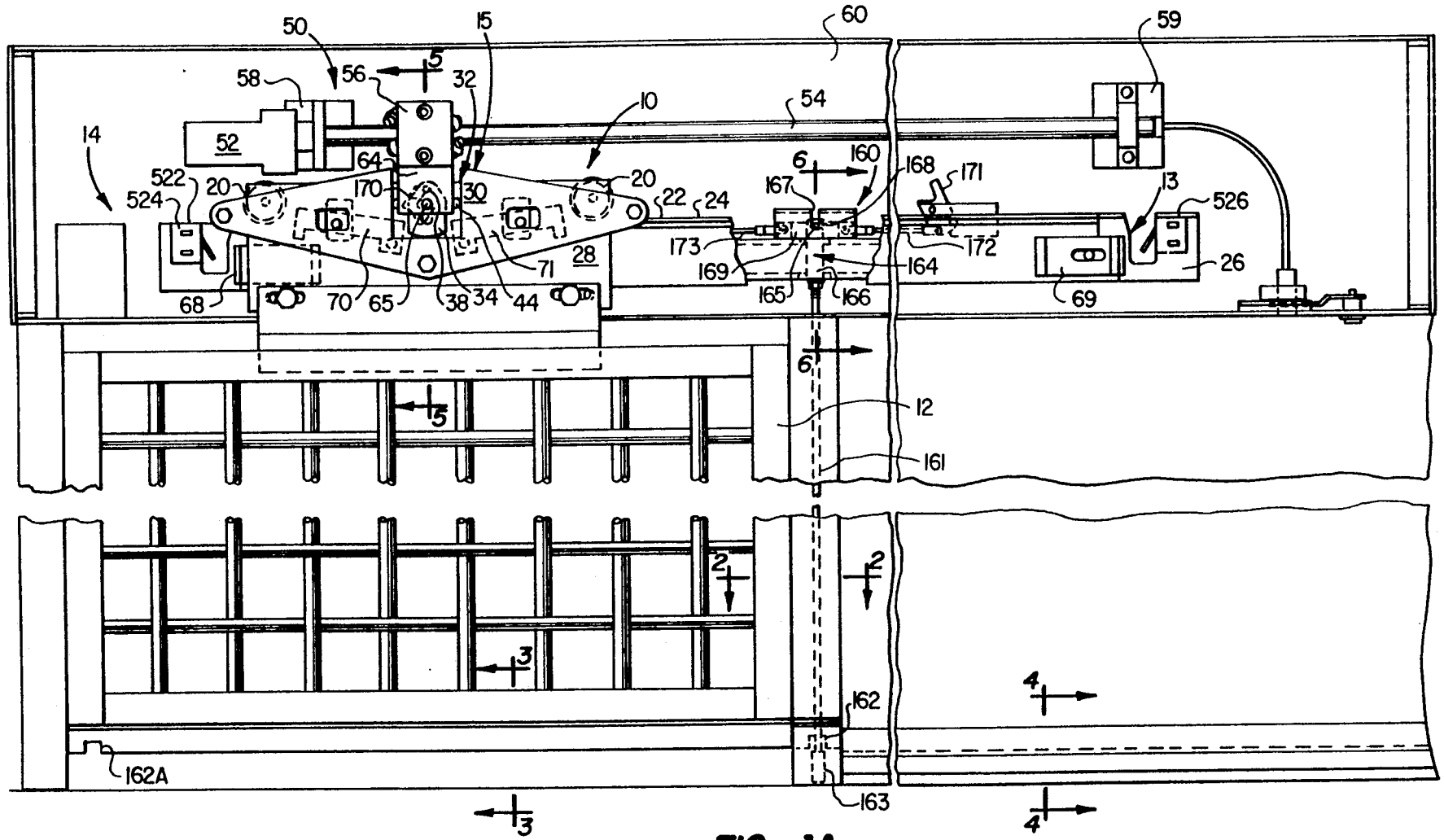
FIG. 1A. is a front elevational, fragmentary view of the detention cell locking system of the present invention with sections cut away for illustrating the operation thereof in a first position with the detention cell door closed and not looked.

Referring first to FIG. 1A there is shown a front elevational view of a detention cell locking system 10 constructed in accordance with the principles of the present invention. Looking system 10 includes a cell door 12 suspended from an overhead frame 13 disposed in a transom 14. The door 12 is suspended from the frame 13 (seen best in FIG. 5) by a carriage assembly 15 and its position both controlled and secured by said carriage assembly 15. It should be noted that in the present system 10, it is contemplated that a plurality of detention cell doors 12 could be utilized, as in a cell bank, for simultaneous operation thereof. Therein, each door assembly would include a transom 14 within which is mounted the carriage assembly 15 providing the multiple advantages described below.

Referring still to FIG 1A, the carriage assembly 15 is mounted within transom 14 by a support track 22 secured to frame 13. A pair of grooved rollers 20 are disposed upon the track 22 which is formed with an angulated top surface 24 matching the groove in the surface of the rollers 20. The track 22 is mounted to a transom mounting plate 26, secured to frame 13 and supporting said track for the mounting of the carriage 15 thereupon. The carriage 15 comprises a carriage plate 28 upon which is pivotally mounted a first, large toggle plate 30. The large toggle plate 30 is constructed with a central notched region 32 adapted to receive a second, small toggle plate 34 therein. Toggle plate 34 is mounted to the carriage plate 28 by a pivot pin 38, shown in phantom in this view.

Referring still to FIG. 1A the movement of the carriage plate 28 is imparted by a drive system 50 comprising a DC drive motor 52 coupled to a drive shaft 54 having a bearing mounted, translational block 56 mounted thereon. The translational block may be of the type manufactured under the trademark Rohlix, Zero Max of Minneapolis, MN. Block 56 provides rectilinear movement in response to rotational movement along the smooth, cylindrical drive shaft 54 disposed therein. Opposite ends of the drive shaft 54 are secured by mounting brackets 58 and 59, mounted to transom header plate 60. Also mounted to header plate 60 is frame 13, as will be described in more detail below. Movement of the carriage plate 28 is provided by the rectilinear motion of the translational drive block 56 which is coupled to drive bracket 64 secured to the carriage plate 28. A drive pin 65 also extends from the drive bracket 64 to engage the small toggle plate 34. Oppositely disposed locking brackets 68 and 69 are likewise shown disposed upon and secured to plate 26. The locking brackets 68 and 69 are adapted for matingly engaging pivotal locking arms 70 and 71, pivotally mounted to the rear of carriage plate 28. The brackets 68 and 69 are also positioned to engage and stop the lateral movement of a section of the carriage assembly 15, as described below. A description of the operation of locking arms 70 and 71 as well as the toggle plates 30 and 34 requires a detailed reference to carriage assembly 15.

Figure 9:
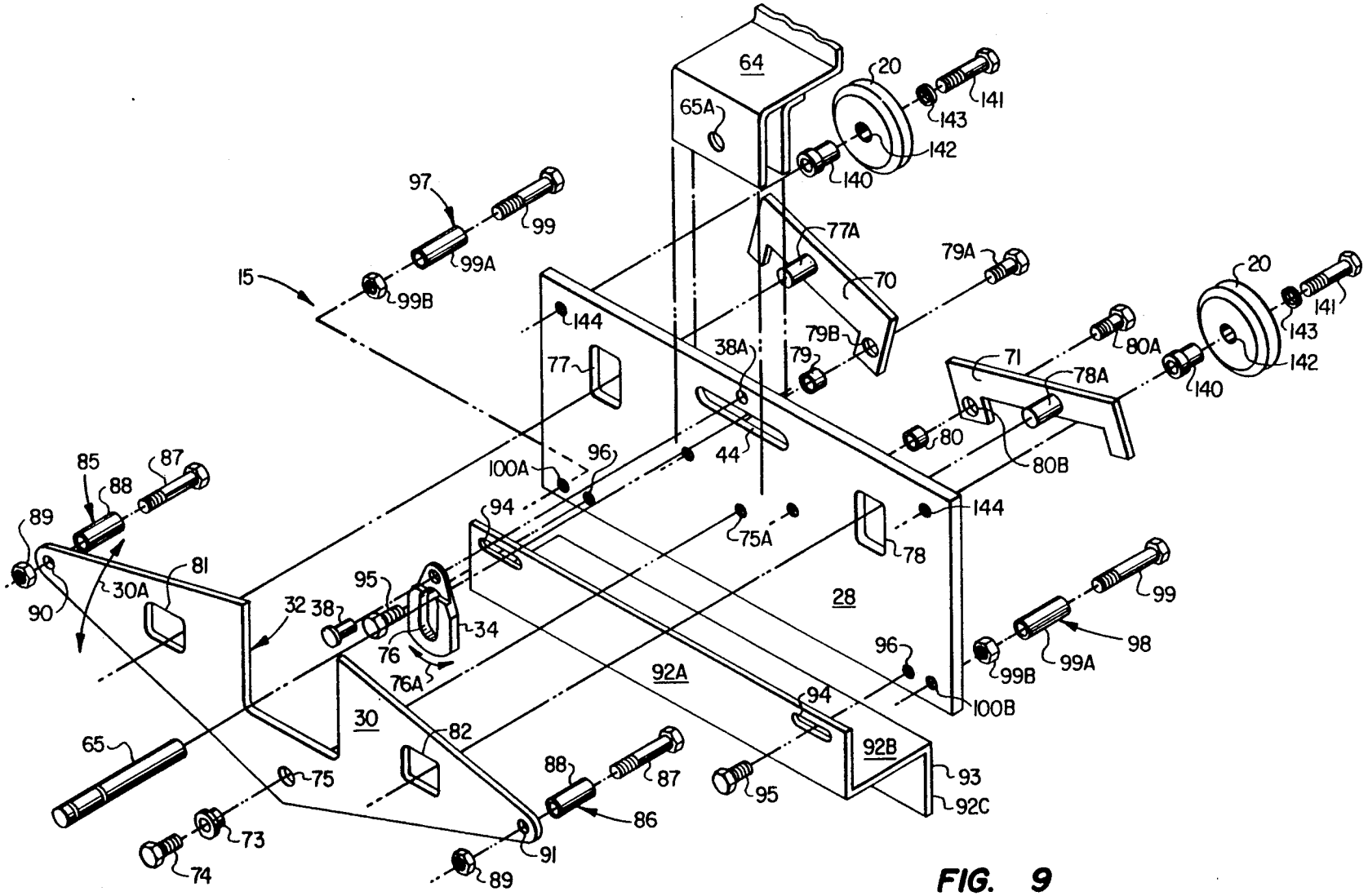
FIG. 9 is an enlarged, exploded, perspective view of the carriage plate assembly of FIG. 1A illustrating the assembly of the various elements thereof.

Referring now to FIG. 9 there is shown an enlarged, exploded, perspective view of the carriage assembly 15 of FIG. 1A illustrating in more detail the individual elements thereof. The large toggle plate 30 is shown to be pivotally mounted to the carriage plate 28 by a bushing 73 that is secured by a threaded member or bolt 74 extending through aperture 75 of toggle plate 30 and into threaded aperture 75A of carriage plate 28. In this manner, toggle plate 30 is permitted to pivot in the direction of arrow 30A illustrated thereon about bushing 73. Likewise, small toggle plate 34 is pivotally mounted to carriage plate 28 by a mounting pin 38 that is secured within aperture 38A formed in the carriage plate 28. The small toggle plate 34 is formed with elongate slot 76 which is adapted for receiving pin 65 there through. The pin 65 is received within slot 44 of carriage plate 28 and into aperture 65A of drive bracket 64. In this manner, lateral movement of drive bracket 64 imparts lateral movement to pin 65 causing lateral movement of the small toggle plate 34 by virtue of its position within slot 76. The lateral movement of small toggle plate 34 will result in its pivotal motion in the direction of arrow 76A about pivot pin 38 when carriage plate 28 is prevented from moving The mounting of the toggle plates 30 and 34, as herein described, thus permits lost motion actuation facilitating the locking and unlocking of the cell door 12 as will be described below.

Still referring to FIG. 9, the carriage plate 28 is likewise constructed with a pair of oppositely disposed apertures 77 and 78, which apertures provide windows for the receipt of fingers 77A and 78A extending from locking arms 70 and 71, respectively. Locking arms 70 and 71 are pivotally mounted to the carriage plate 28 by bushings 79 and 80, respectively, each secured by bolts 79A and 80A, respectively. An aperture 79B is formed within locking arm 70 and is adapted for receipt of bolt 79A. Likewise, an aperture 80B is formed in locking arm 71 adapted for receipt of bolt 80A for the pivotal mounting thereof. It will be seen that the vertical movement of fingers 77A and 78A within windows 77 and 78 permit the engagement and disengagement of the locking arm 70 and 71 with the appropriate locking brackets 68 and 69. In this manner, it will likewise be seen that this actuation is provided by the pivotal, lost motion of the toggle plate 30 by virtue of the capture of fingers 77A and 78A in slotted windows 81 and 82 Upon assembly, it may be seen that windows 81 and 82 of toggle plate 30 are positioned in general registry with windows 77 and 78 of carriage plate 28 through which finger 77A and 78A are permitted to extend. Pivotal movement of the toggle plate 30 in the direction of arrow 30A thus provides selected engagement and disengagement of the fingers 77A and 78A for the pivotal actuation thereof.

Referring still to FIG. 9, the toggle plate 30 is assembled with oppositely disposed cell door locking members 85 and 86. Each of the looking members 85 and 86 include a bolt 87 which extends through a bushing 88 to therein be secured by a nut 89 to toggle plate 30. The corner apertures 90 and 91 of toggle plate 30 are formed in the opposite ends thereof for purposes of receiving the bolts 87 therethrough. Once assembled, the locking members 85 and 86 provide the necessary element for engagement with slotted regions of plate 26 for locking the carriage assembly 15 in place by virtue of the lost motion, pivotal movement of the toggle plate 30.

Figure 5:
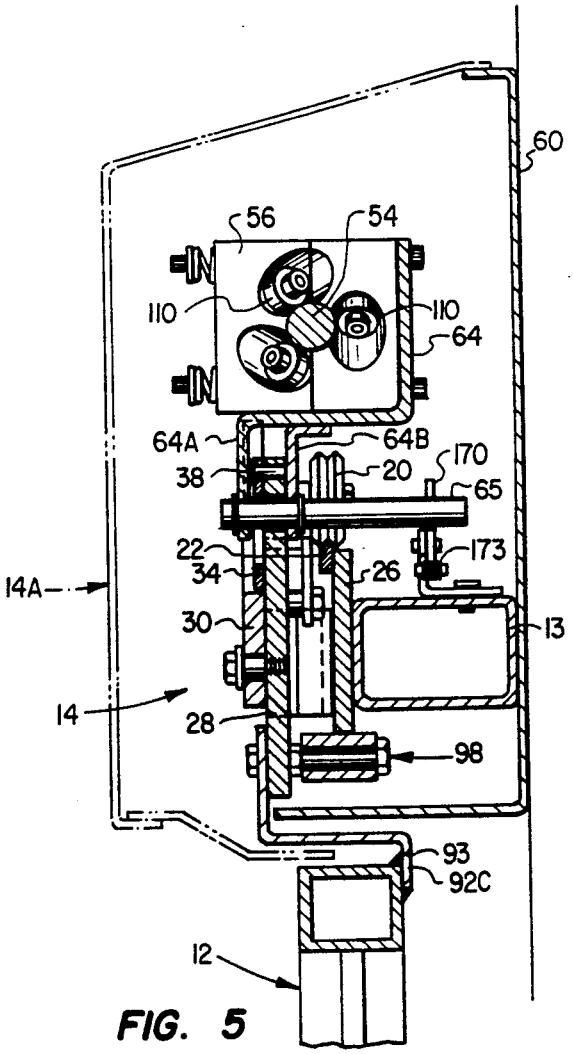
FIG. 5 is an enlarged, fragmentary, end-elevational cross-sectional view of the carriage assembly of FIG. 1A taken along lines 5—5 thereof.

The locking engagement by members 85 and 86 comprise but the first of three separate locks of the cell door 12. As shown in FIGS. 1A–1D, the cell door 12 is secured to the carriage plate 28 by angle frame 92. The frame 92 is constructed with separate flange regions 92A, 92B and 92C. Region 92A includes slotted portions 94 adapted for receiving threaded members in the form of bolts 95 therethrough to be secured within threaded apertures 96 formed in the carriage plate 28. The cell door 12 is secured to flange region 92C by welding or the like (as seen in FIG. 5). As seen in FIG. 9, the carriage plate 28 is itself constructed with a pair of oppositely disposed stabilization members 97 and 98. Each member 97 and 98 is constructed with a threaded element or bolt 99 which extends through a bushing 99A that is secured by nut 99B after said bolt projects through apertures 100A and 100B formed on opposite corners of the carriage plate 28. The stabilization members 97 and 98 secure the carriage assembly 15 to the track 22 by riding beneath the mounting plate 26.

Referring one more time to FIG. 9, the assembly of support rollers 20 is more clearly shown. Each roller 20 is secured to the carriage plate 28 by a bushing 140 which is held by a bolt 141 that extends through an aperture 142 formed centrally in each roller 20. A washer 143 is preferably provided for mounting the bolt 141 to the roller 20, and a threaded aperture 144 is formed in opposite top corners of the carriage plate 28 for the direct mounting thereto. The mounting of rollers 20 to carriage plate 28 as herein described permits the carriage plate 28 to support, and control all lateral movement of, the cell door 12. Said movement is therein controlled by the drive block 56, the operation of which will be discussed below.

Figure 10:
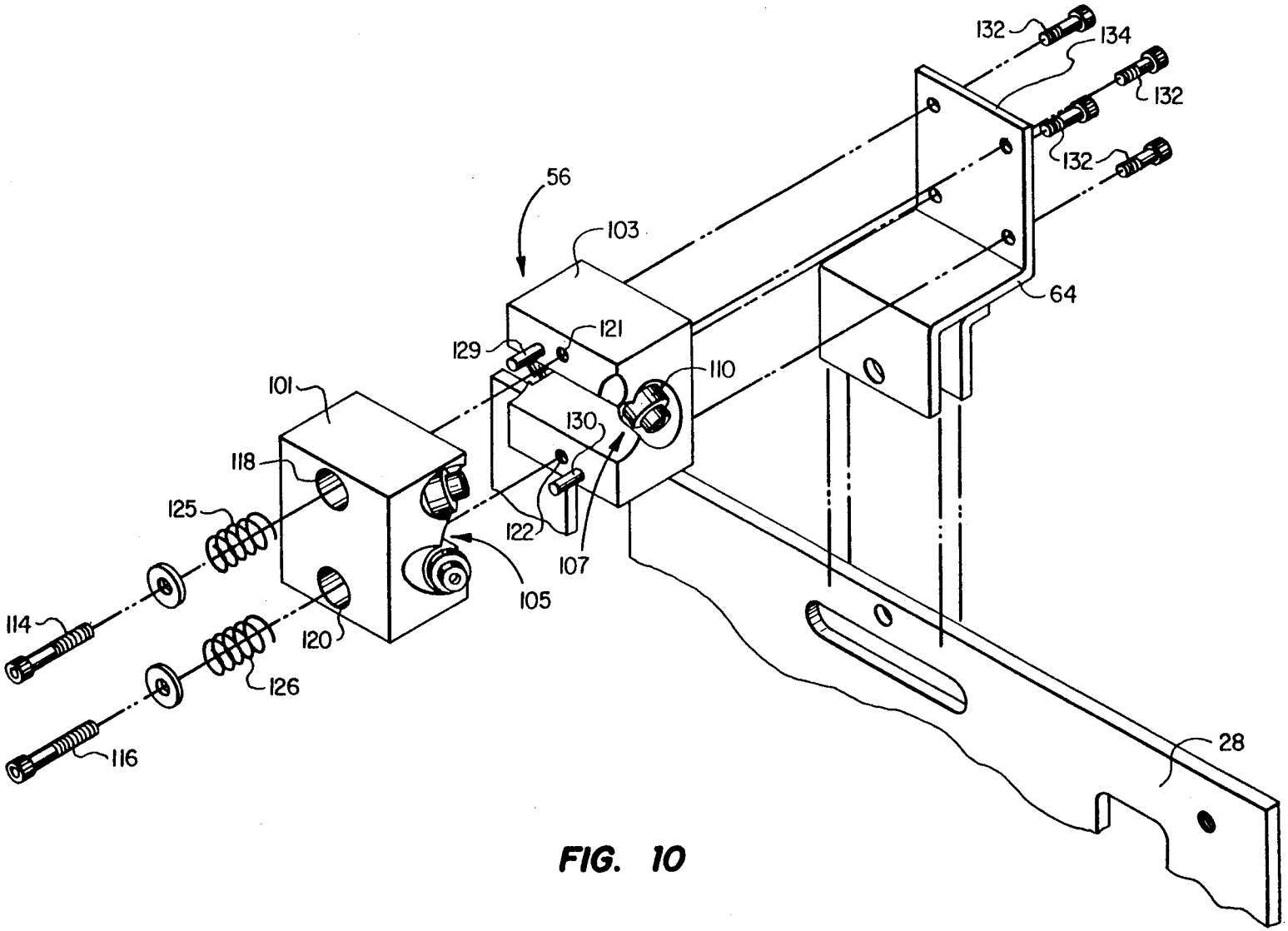
FIG. 10 is an enlarged, exploded, perspective view of the drive block of FIG. 1A illustrating the assembly of the various elements thereof.

Referring now to FIG. 10, there is shown an enlarged, perspective, exploded view of the above-referenced translational block 56 and its assembly herein. The block 56 is preferably constructed of two sections, 101 and 103. Sections 101 and 103 are each formed with mating semi-cylindrical, out-out regions 105 and 107, respectively. When blocks 101 and 103 are assembled one to the other, cut-outs 105 and 107 form a single, substantially cylindrical aperture therethrough. The semi-cylindrical cut-outs 105 and 107 have mounted therein precisely angulated roller bearings 110 which angularly engage the shaft 54 during its rotation.

The rotation of the shaft against the angulated bearings 110 then creates a rectilinear driving force along the axis of said shaft. Since the shaft 54 is smooth, the driving force is generated through the frictional engagement of the bearing surfaces and the outer surface of the shaft. The tension between blocks 101 and 103 upon the shaft 54 therefore controls the frictional engagement of the bearings 110 and the resulting frictional driving force thereof. In that regard, threaded fastener members 114 and 116 are shown mounted through apertures 118 and 120, respectively of block 101 and are threadably received within threaded apertures 121 and 122 of block 103. The compressive force between blocks 101 and 103 is thereby established by the threaded engagement of threaded members 114 and 116 against spring members 125 and 126 assembled thereon. It may be seen that compression of the spring members 125 and 126 will cause an increase in the force applied to the shaft 54 by bearing 110. Guide pins 129 and 130 are also shown in this particular embodiment for alignment of said blocks 101 and 103 one to the other during assembly thereof. The drive bracket 64 is also shown in this view in enlarged detail, illustrating its direct mounting to section 103 by a plurality of bolts 132 extending through upstanding plate section 134.

Referring back now to FIG. 1A, the operation of the present invention may thus be seen to comprise lost motion actuation of the large toggle plate 30 and small toggle plate 34 produced by the rectilinear motion of the drive block 56 as described above. The rectilinear motion is translated into the lost motion of the toggle plates 30 and 34 through the mechanical linkage coupling the small toggle plate 34 to the large toggle plate in the cutout region thereof. Both toggle plates 30 and 34 are pivotally mounted to the carriage plate 28 in such a manner that the termination of the lateral movement of the carriage plate 28 by stops 68 and 69 on either of the opposite ends of the carriage track 22 results in the separate movement of said small and large toggle plates by the drive block 56. This movement is imparted by the drive block 56 which continues to move relative to the carriage plate 28. Pivotal movement of the small toggle plate 34 is caused by virtue of the drive pin 65 extending from the drive bracket 64. The movement is permitted by the slot 44 in the carriage plate 28, which movement therein causes pivotal actuation of the small toggle plate 34 about the mounting pin 38. The small toggle plate 34 moves to engage the side portion of the slot 32 of the large toggle plate 30 and therein imparts a turning moment thereon. The turning moment causes one end of the large toggle plate 30 to pivot downwardly, which downward motion both locks the carriage assembly 15 from further rectilinear motion and engages a microswitch (described below) which terminates the electrical drive system thereof. The downward pivoting of the toggle plate 30 likewise permits opposite ends of locking arms 70 and 71 to engage locking brackets 68 and 69 by downward pivotal movement of said respective locking arm. As will be described below, in this position, the drive assembly 50 has likewise engaged the requisite linkage described below for actuating the vertical locking bar of the detention cell door 12.

Unlocking of the detention cell door is likewise accomplished by movement of the drive block in the reverse direction. Actuation of the DC drive motor in reverse causes movement of the drive block in the opposite direction, imparting the drive pin 65 to move laterally within the carriage plate slot 44. Such movement causes the counterclockwise pivotal movement of the small toggle plate 34, which movement causes the bottom arcuate region of said small toggle plate to engage the opposite slotted portion of the large toggle plate 30 generating the clockwise pivotal motion thereof. Clockwise pivotal motion causes the end of the large toggle plate 30 to disengage the locking slot as will be described below. Continued motion of the drive assembly also permits unlocking movement of the locking bar engagement cam to facilitate the downward movement of the vertical locking bar. Thus within a few centimeters of movement of the drive block 56, complete unlocking of the detention cell door is afforded. Once the small toggle plate 34 has moved into engagement with the large toggle plate 30, all of the above-described unlocking motion has occurred and the large toggle plate 30 is free to move with the detention cell door 12 in the opening of said door.

Figure 1B:
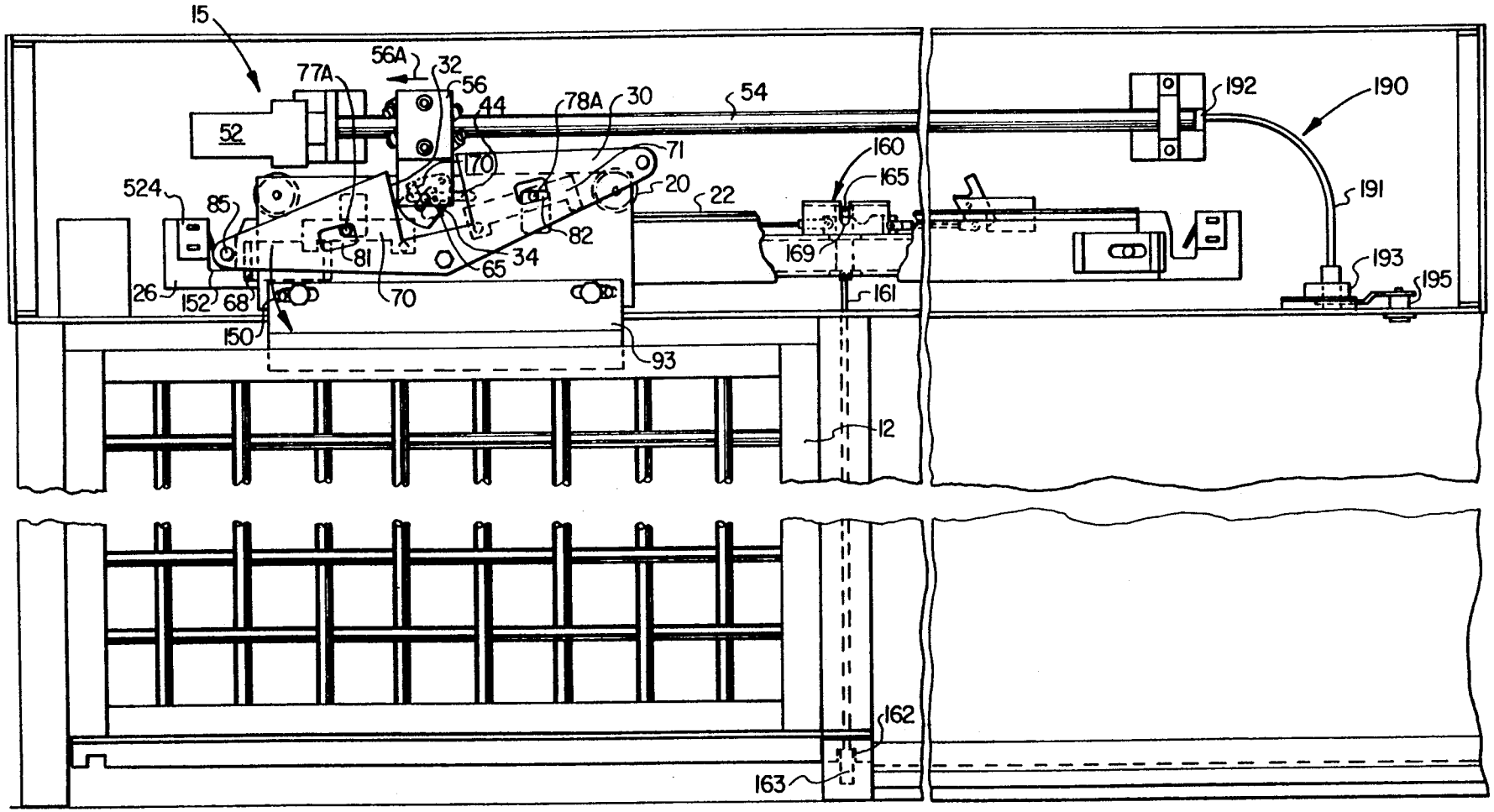
FIG. 1B a front elevational, fragmentary view of the detention cell locking system of FIG. 1A illustrating the locked, closed position of the detention cell door thereof.

Referring now to FIG. 1B, there is shown the detention cell door 12 in the closed and locked position, with carriage assembly 15 providing locking engagement thereof. In this position, the toggle plate 30 has pivoted downwardly in the direction of arrow 150 whereby locking arm assembly 85 has dropped into slotted region 152 of plate 26. The locking arm 85 has then engaged microswitch 522 terminating electricity to DC drive motor 52 and, consequently, the rectilinear motion of the drive block 56. The movement of mechanical parts resulting in the pivoting of toggle plate 30 in the direction of arrow 150 may be compared to FIG. 1A. In such a comparison, it may be seen that the drive block 56 has moved to the left in the direction of arrow 56A resulting in the movement of pin 65 in the same direction, which movement has imparted a pivotal motion to small toggle plate 34. The movement of small toggle plate 34 has caused it to engage large toggle plate 30 in the notch region 32 thereof to cause the pivotal movement illustrated herein. The pivotal movement of toggle plate 30 has, consequently, caused window 81 to drop downwardly, pulling finger 77A of locking arm 70 downwardly into engagement with locking bracket 68 as shown in phantom. At the same time, window 82 has moved upwardly lifting finger 78A and locking arm 71, also shown in phantom. In this position, the carriage assembly 15 is thus locked in position by virtue of the engagement of locking arm assembly 85 in the notch 152 of plate 26 and the locking arm 70 in engagement with locking bracket 68. A third locking mechanism is provided in the vertical lock bar assembly 160 as will be described in more detail below.

Figure 1C:
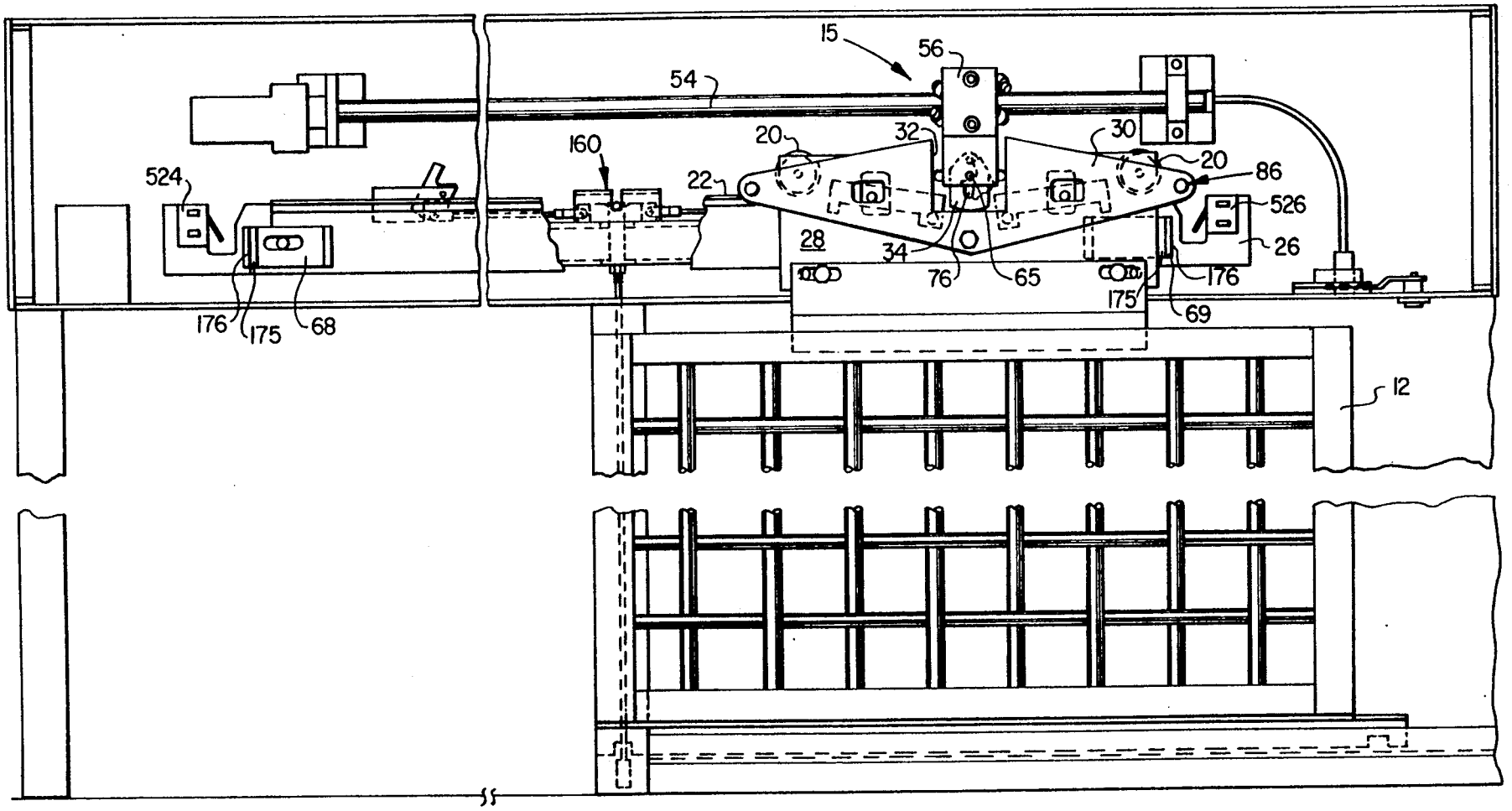
FIG. 1C is a front elevational, fragmentary view of the detention cell locking system of FIG. 1A with the detention cell door in a second, open, unlocked position.

Referring now to FIG. 1C, the carriage assembly 15 and cell door 12 is shown in an open, unlocked position. In this particular position, the toggle plate 30 remains in a substantially horizontal position supported by rollers 20 upon track 22 prior to any lost motion pivotal action thereof. Drive block 56 is positioned upon shaft 54 at a distance from the end thereof permitting the small toggle plate 34 to remain generally vertically aligned. Drive pin 65 is shown extending outwardly from the slot 76 of small toggle plate 34 in its position for controlling the angular orientation thereof. In this position, the cell door 12 is not yet locked in its open position, although it has travelled to the limit of its permissible rectilinear motion. This limit of rectilinear motion is controlled by the locking brackets 68 and 69. Each locking bracket 68 and 69 is constructed with a bumper 175, which bumper is disposed on the outside flange 176 of each of the mounting brackets 68 and 69. The bumper 175 is positioned to abut the side of carriage plate 28 for terminating its rectilinear movement while said drive block continues to move upon drive shaft 54. Continued movement of drive block 56 upon shaft 54 thus imparts lateral movement to pin 65 and the resulting pivotal movement of small toggle plate 34 within the notch 32 of toggle plate 30, as described above. It may be seen that in this position, prior to the locking of cell door 12 in the open position, the microswitch 526 disposed oppositely microswitch 524 upon plate 26 stands in a position for engagement with the locking arm assembly 86.

Figure 1D:
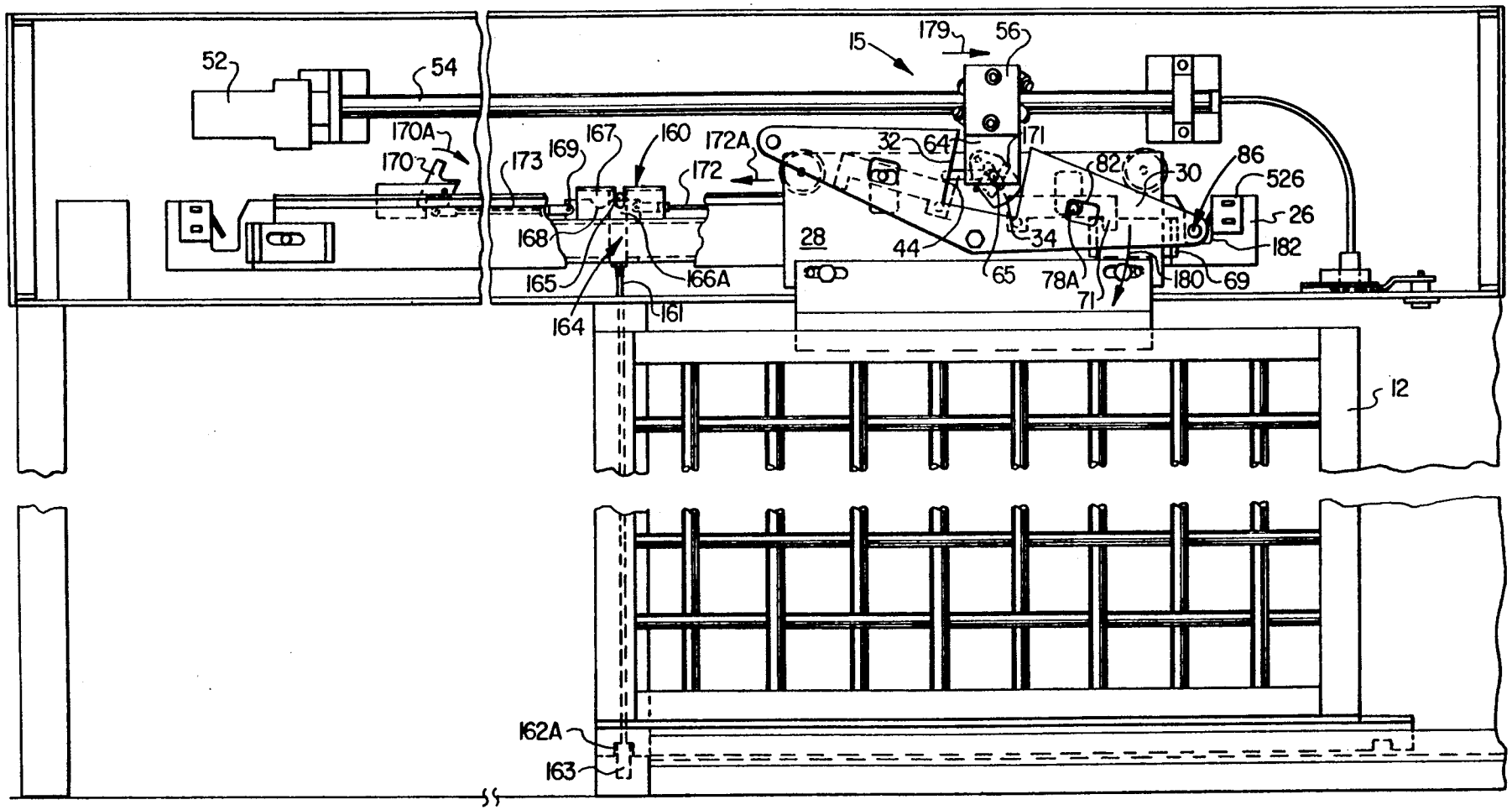
FIG. 1D, is a front elevational, fragmentary view of the detention cell locking system of FIG. 1C illustrating the locked, open position of the detention cell door thereof.

Referring now to FIG. 1D, the drive block 56 has moved to the right in the direction of arrow 179 relative to its position in FIG. 1C. In this new position, the drive shaft 65 has moved within the horizontal slot 44 of carriage plate 28 to impart pivotal movement to small toggle plate 34 causing it to engage the side of notch 32 of toggle plate 30 imparting a turning moment thereon and a downward pivoting thereof in the direction of arrow 180. Movement of the toggle plate 30 in the direction of arrow 180 has caused the locking arm 86 to slide into locking recess 182 of plate 26 to lock the carriage assembly 15 in this open position and, simultaneously, the engagement of microswitch 526 by locking arm 86. The engagement of microswitch 526 terminates the rotation of shaft 54 by terminating the electricity in drive motor 52. Again, in this position, the locking arms 70 and 71 are actuated wherein locking arm 71 has engaged locking bracket 69 by virtue of the downward movement of window 82 and the finger 78A of locking arm 71 as described above. Thus, the cell door 12 is locked in the open position by the above two described locked engagements provided by the pivotal movement of toggle plate 30. As stated above, a third locking system is provided by the vertical drop bar assembly 160 as will be described in more detail below.

FIGS. 1A through 1D illustrate the vertical lock bar actuation system 160 in two, opposite positions. In FIG. 1A, the lower elements of vertical lock bar 161 may be seen to depend below cell door 12 and out of engagement with locking slot 162 formed in a flange of the cell door 12. A locking bar section 163, adapted for matingly engaging the locking slot 162 is positioned downwardly therefrom in response to the position of the upper actuation section 164. Actuation section 164 comprises a cam system which responds to the positioning of carriage plate 28, as seen most clearly in FIG. 6.

Figure 6:
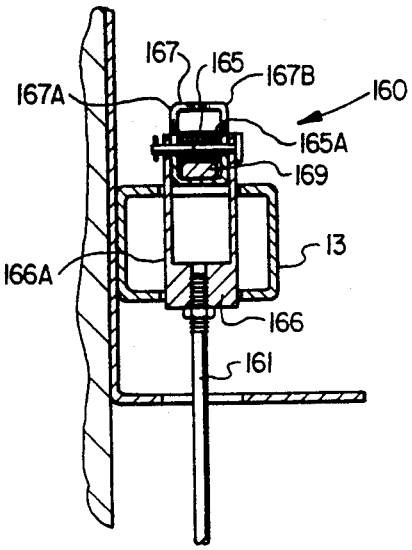
FIG. 6 is an enlarged, fragmentary, end-elevational, cross-sectional view of the vertical bar locking mechanism of FIG. 1A taken along lines 613 6 thereof.

Referring now to FIG. 6, there is shown an enlarged, end-elevational cross-sectional view of the actuation section 164 of the lock bar assembly 160. Vertical lock bar 161 is shown secured beneath a mounting member 166 that is disposed through frame 13. The mounting member 166 includes yoke 166A that supports shaft 165 therethrough Shaft 165 forms a cam follower with a bushing 165A disposed thereover The shaft 165 extends outwardly from opposite sides of a yoke 166A as shown herein and supports the top of vertical locking bar 161. The cam follower 165 also extends through tubular housing 167 which is formed with oppositely disposed vertical slots 167A and 167B. The slots 167A and 167B permit vertical movement of cam follower 165 produced by its position upon horizontal cam member 169. The cam member 169 is reciprocally mounted within housing 167 and is formed with an arcuate cam section 168. The arcuate cam section 168 comprises a portion of horizontal cam 169 which is coupled to opposite actuation levers 170 and 171 (shown in FIG. 1A).

Referring back to FIG. 1A, lever 170 is disposed on the left hand side of the drawing of FIG. 1A and is shown in phantom in view of the fact that it is disposed behind the carriage assembly 15. On the right hand side of the frame 26, the actuation member 171 is presented and is shown to be coupled to the cam body 169 by a linkage member 172. A similar linkage member 173 is coupled the lever 170. Actuation of the lever 170 and 171 in opposite directions imparts select movement to the arcuate surface 168 which imparts vertical movement to the cam follower 165 and reciprocal vertical movement of the vertical locking arm 161, resulting in engagement or disengagement of the locking section 163 with the cell door locking slot 162. It may be seen in FIG. 1A that a second locking slot 162A is presented on the left hand side of the cell door 12 for select engagement by locking member 163 in the open position shown in FIG. 1D.

Referring now to FIG. 1D there is shown the cam follower 165 disposed outwardly of the arcuate region 168 and atop the body of the cam 169 whereby the vertical locking bar 161 has been positioned upwardly to cause the locking member 163 to engage the locking slot 162A of cell door 12. This engagement has resulted from the movement of lever 171 by virtue of its engagement with drive pin 65 extending from the mounting bracket 64 secured to the drive block 56. The engagement of the cam levers 170 and 171 occurs simultaneously with the lost motion actuation of the pivot plates 30 and 34. It may be seen that movement of the shafts 172 and 173 in the direction of arrow 172A causes lever member 170 to move arcuately in the direction of arrow 170A. When the carriage assembly 15 moves into the closed position shown in FIG. 1A, it is in a position prepatory to engagement with, and actuation of, lever member 170 for similar rectilinear movement of the cam body 169 and the locking of the cell door in the closed position by the vertical bar. This particular locked configuration is shown in FIG. 1B.

Referring now to FIG. 1B, it may be seen that the cam follower 165 again rests atop the cam body 169 in a position that has caused the vertical bar 161 to rise upwardly causing the locking member 163 to engage the locking section 162, which action has occurred by virtue of the movement of pin 65 in the direction of arrow 56A resulting in the actuation of lever 170 and the movement described above. The vertical locking member 163 thus provides yet a third backup locking system in accordance with the principles of the present invention.

Referring now to FIGS. 1A through 1D, in combination, it may be seen that manual actuation of the shaft 54 and thus the movement of the carriage assembly 15 can be produced by a manual mechanical override means. Manual mechanical drive system 190 thus includes a flexible drive cable 191 which is secured to the end 192 of shaft 54. A drive assembly 193 is secured to the lower region of the transom 14 in a position to facilitate engagement by a mechanical driving member. A lock 195 is presented which is a backup to preventing access to the manual override assembly 190. Manual mechanical override systems are conventional in the prior art.

Figure 2:
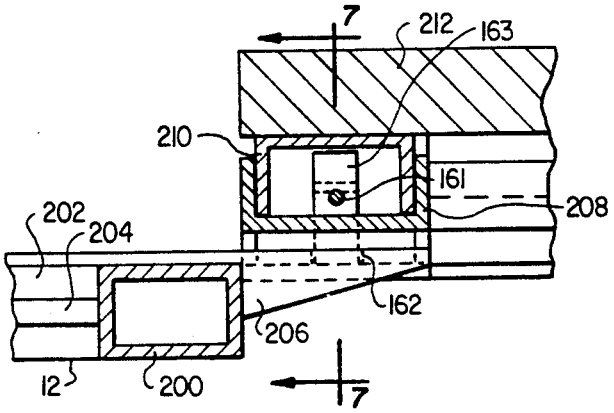
FIG. 2 is an enlarged, fragmentary, top plan cross-sectional view of the detention cell door frame of FIG. 1A taken along lines 2—2 thereof.

Referring now to FIG. 2, there is shown an enlarged fragmentary top plan, cross sectional view of the cell door and cell frame assembly of FIG. 1A illustrating the vertical lock bar 161 therein. The cell door 12 is seen to include a vertical channel member 200 which upstands from a lower frame section 202. Cell bar 204 is shown disposed thereabove and in secured engagement with vertical side frame member 200. A flange section 206 extends laterally from the horizontal frame member 202 as will be seen more clearly in FIG. 3. The flange 206 is formed with a slotted portion 162 as may be seen most clearly in FIG. 7. The slotted portion 162 is sized for receiving the locking member 163 as discussed above. The vertical bar 161 is shown in cross section as are the sidewall channels 208 and 210 forming the sidewall channel adjacent to cell door 12. A wall 212 is likewise shown in flush engagement with channel section 210.

Figure 3:
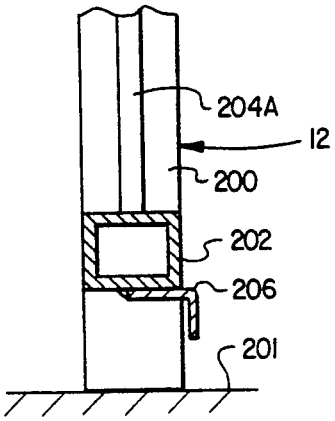
FIG. 3 is an enlarged, fragmentary, end-elevational, cross-sectional view of the lower door frame member of FIG. 1A taken along lines 3—3 thereof.

Referring now to FIG. 3, there is shown an enlarged, end-elevational, cross-sectional view of the cell door 12 of FIG. 1A taken along the lines 3—3 thereof. Vertical member 200 is shown disposed in orthogonal relationship with horizontal cell door frame member 202 which is shown to be secured to flange 206 by welding, or the like. Flange 206 depends downwardly from horizontal member 202 to provide both a skirt for, and means by which, the cell door 12 can be locked. A vertical detention bar 204A is shown for purposes of illustration. Likewise, floor 20 is illustrated for purposes of reference.

Figure 4:
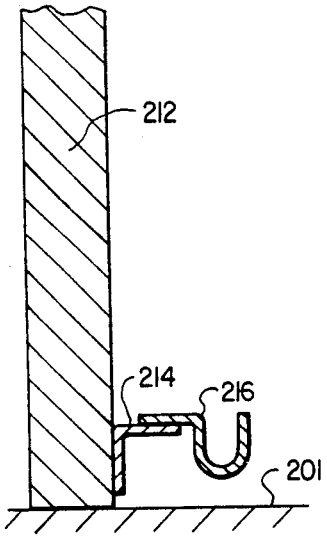
FIG. 4 is an enlarged, fragmentary, end-elevational, cross-sectional view of the lower door track of FIG. 1A taken along lines 4—4 thereof.

Referring now to FIG. 4, there is shown an enlarged, end-elevational cross-sectional view of the detention cell wall and lower support track of FIG. 1A taken along lines 4—4 thereof. The wall 212 is disposed orthogonally to the floor 201 wherein an L-shaped flange 214 is secured, above floor 201, to wall 212 for support of a generally U-shaped bracket 216. The bracket 216 is sized to receive the depending section of flange 206 of the cell door 12 therein during transverse movement thereof.

Referring now to FIG. 5, there is shown an enlarged, end-elevational cross-sectional view of the carriage assembly 15 of FIG. 1A taken along lines 5—5 thereof. In this particular view, the drive block 56 is clearly shown in intimate engagement with shaft 54 wherein bearing members 110 tightly engage said shaft to impart rectilinear motion to block 56 from the rotation thereof. The mounting and securement of bracket 64 is most clearly shown in this particular view. Also shown is the utilization of drive pin 65, extending outwardly therefrom, for engagement with lever 170 as described above. Drive pin 65 extends between the rollers 20, disposed behind the toggle plate 30. The carriage plate 28 is likewise shown most clearly illustrating the stop assembly 98. The mounted relationship between pivot plate 30 and small pivot plate 34 is also shown in this particular view. More specifically, the pivot plate 34 is shown to be disposed between the flanges 64A and 64B of the mounting bracket 64 which fits over the upper portion of the carriage plate 28. Pin 38 is clearly seen securing the small pivot plate 34 in pivotal relationship with carriage plate 28 in a position responsive to lateral movement of drive pin 65 that is imparted by the drive block 56. Likewise, its engagement with the cam lever 170 is clearly seen and the shaft 173 extending therefrom is more clearly illustrated as discussed above. The cell door 12 is seen to be secured to and depend from the carriage plate 28 by virtue of the cell door mounting bracket 93. The transom 14 is shown to be housed within a cowling 14A shown in phantom.

Figure 7:
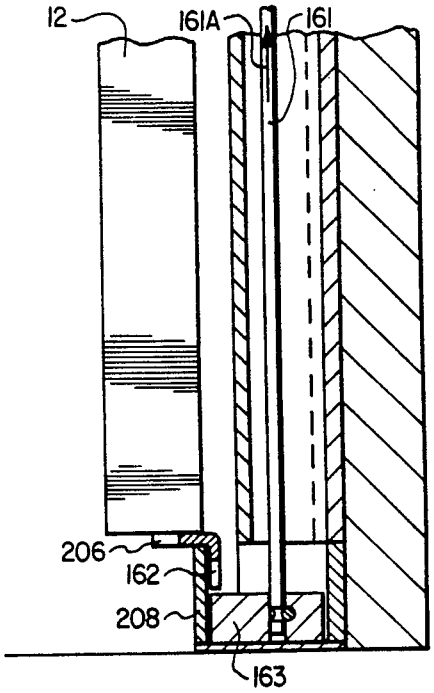
FIG. 7 is an enlarged, fragmentary, end-elevational, cross-sectional view of the vertical lock bar base of FIG. 2, taken along lines 7—7 thereof.

Referring now to FIG. 7, there is shown a end-elevational cross-sectional view of the vertical locking bar 161 mechanism prior to engagement with the cell door of FIG. 2, taken along the lines of 7—7 thereof. The vertical locking bar 161 is shown secured to lower locking member 163. Locking member 163 is disposed in the lower region of channel 208 and is shown in vertical alignment with the slot 162 of flange 206 prepatory to engagement thereof for locking of the cell door 12. As may be seen in this particular view, vertical movement of the locking bar 161, in the direction of arrow 161A, will cause the locking member 163 to rise upwardly into the notched region 162 to prevent lateral movement of the cell door 12 by virtue of the flange 206 secured thereto.

Figure 8:
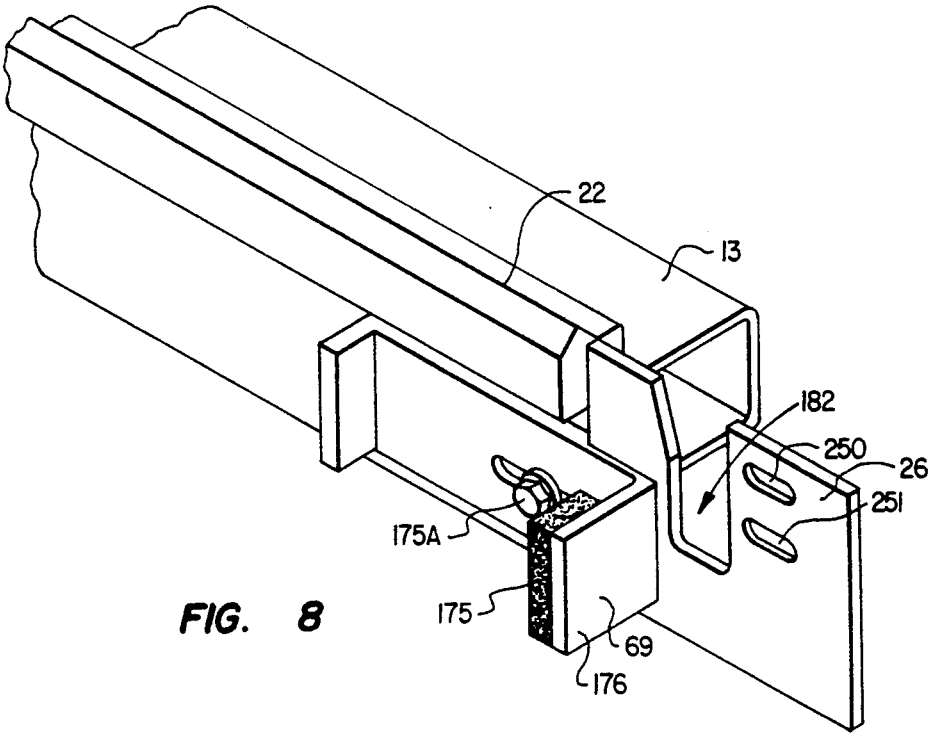
FIG. 8 is an enlarged, perspective, fragmentary view of the carriage support track of FIG. 1A with parts removed for purposes of clarity.

Referring now to FIG. 8, there is shown an enlarged fragmentary perspective view of the mounting plate 26 and the locking slot 182 of FIG. 1D. Plate 26 is seen to be mounted to frame 13. Slot 182 is formed in the plate 26 and apertures 250 and 251 are shown formed therein to facilitate attachment of the microswitch 526 as discussed relative to FIG. 1D. The locking bracket 69 is likewise shown in enlarged detail along with stop element 175. Stop element 175 is preferably formed of appropriate cushioning material and secured to the inside face of flange 176. The bracket 69 is secured to plate 26 by the threaded fastener 175A shown herein. In this particular view, a clear illustration of track 22 is also seen, whereby the top surface thereof is appropriately formed for mating engagement with the rollers 20 as shown herein.

In operation, the detention cell system 10 of the present invention is adapted for utilization with a plurality of detention cell doors 12 and simultaneous control thereof. The utilization of toggle plates 30 and 34, as described above, facilitates both a reliable and effective system for simultaneously controlling multiple cell doors. It may be seen that a variety of improved aspects contribute to the overall efficiency and reliability of the system. Not the least of these aspects is the utilization of a smooth drive shaft 54 used in conjunction with drive block 56 as described above. This assembly will permit the cell door 12 to be stopped during any given opening or closing movement due to the potential slippage between drive block 5 and shaft 54. It is important during the operation of multiple detention cell doors 12 that safety factors be incorporated to prevent the cell door from crushing and injuring individuals being detained thereby. The slippage between drive block 56 and shaft 54 thus prevents a cell door 12 from crushing an individual who is positioned between the cell and a wall region adjacent thereto. This degree of slippage, providing the safety aspect, may be adjusted by the amount of tension imparted between the bearings 110 riding upon shaft 54 as shown most clearly in FIG. 10. It has also been shown herein that in the event of electrical power failure, the drive shaft 54 may be rotated by the manual override system 190. Rotation of shaft 54 by electrical or manual operation will produce the same effect because all actuation of toggle plates 30 and 34 is in response to the movement of drive block 56.

Figures 11, 12:
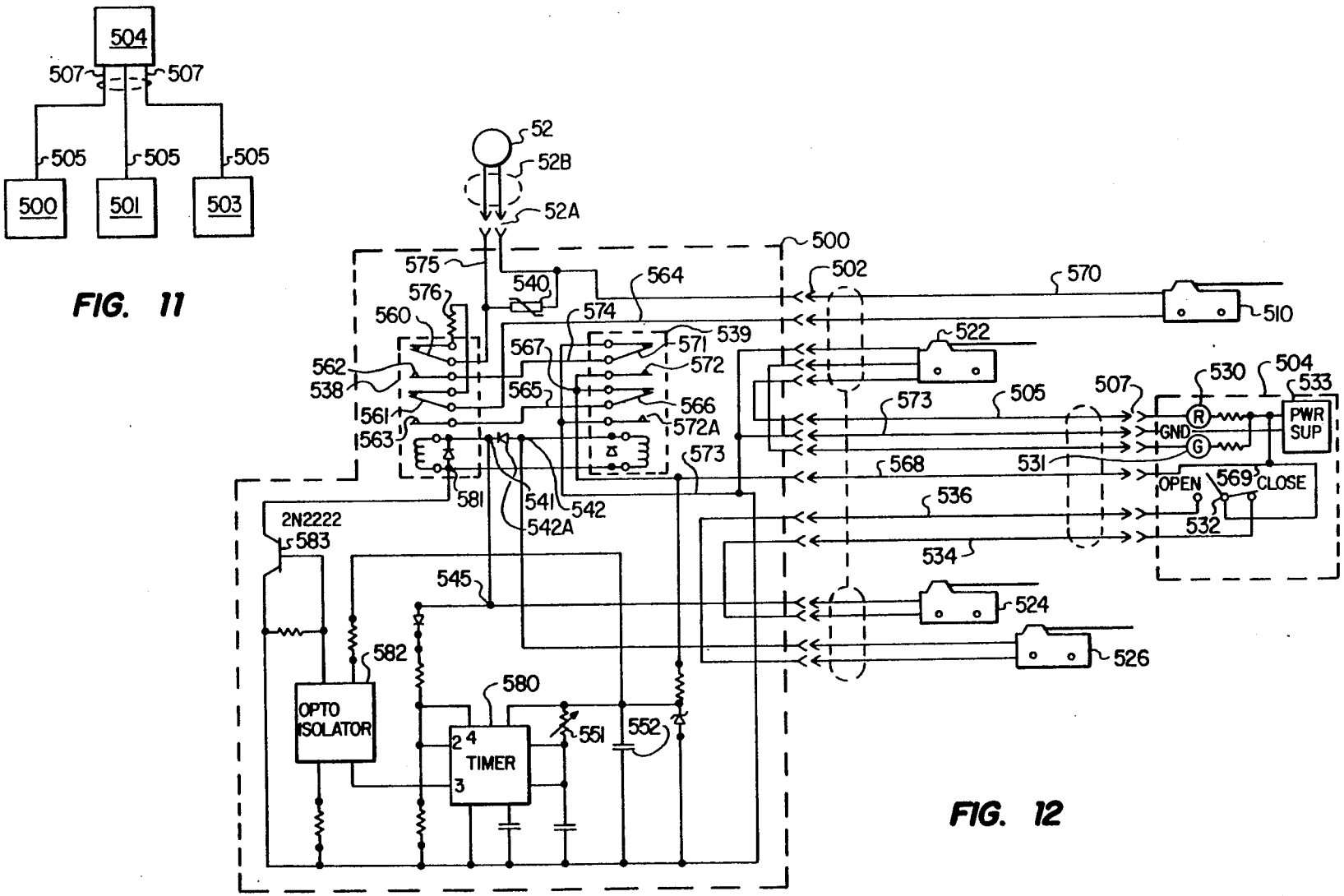
FIG. 11 is a block diagram illustrating the control of multiple cell blocks in accordance with the principles of the present invention.
FIG. 12 is a schematic diagram of one embodiment of a control network constructed in accordance with the principles of the present invention and controlling a single detention cell door.

Referring now to FIG. 11, there is shown a block diagram of a control panel 504 tied to a multitude of detention cell control systems 500, 501, and 503. Each detention of the cell system 500, 501, and 503 is connected to the control panel 504 by a coupling harness 505 which extends from the respective detention cell system to the control panel 504 through a connector plug 507. The connector 507 provides electrical communication between the control panel 504 and the respective detention cell control network 500, 501, and 503 as shown in FIG. 11.

Referring now to FIG. 12, there is shown a schematic diagram of the operation and functioning of one embodiment of the present invention. As shown therein, the power to drive motor 52 is provided through a two pin connector 52A, the wires of which are shown to be tied together by harness assembly 52B The connector 52A connects the motor 52 with the operation circuit 500 which controls the power to, and the direction of, the rotation of motor 52. The control of the system 500 is affected through the control console 504 which is coupled thereto by a cable assembly 505 which is connected to the control module 504 through multi pin connector 507 and to system 500 by connector 502. Three microswitches 522, 524, 526 are used in conjunction therewith and are likewise connected across multi pin connector 502 for simultaneous activation and control of network 500.

Still referring to FIG. 12, the control console 504 includes actuatable indicia in the form of LED displays 530 and 531. LED 530 is a red LED display which indicates that the door is unlocked. LED 531 is a green LED display indicating that the door is locked. The LEDs are both connected to the door position microswitch 522 through harness 505 for deriving their signals therefrom. The position of the cell door 12 controls the activation of the door microswitch 522 as seen in FIG. 1A. The control of the cell door 12 shown in FIG. 1A is effected by the maintained contact switch 532 which, in the present diagram, is shown in the closed position. In this position, connection is made between the power supply 533 and wire 534 of harness 505 through connector 502 to close limit switch 524. Upon the closure of the cell door 12, the limit switch 524 is actuated to terminate the gear motor 52. Likewise the open limit switch 526 is coupled to the power supply 533, which may be a 24 volt power supply through maintained contact switch 532 through connector wire 536. Switch 526, too, is responsive to the position of the door 12 in the open position, the sensing of which breaks the current to terminate further action of gear motor 52. Both microswitches 524 and 526 are connected to the gear motor 52 through relays 538 and 539. It may be seen from the discussion above that the 24 volt power supply 533 is connected to the open or close command line of the control console 504 through the maintained contact switch 532. The switch 532 imparts select rotation to motor 52 through the relays 538 and 539. Relay 539 is a "direction relay" while relay 538 is a power relay. Relay 538 is directly coupled to the close limit switch 524 and said 24 volt power through node 541. Switch 524 then activates the relay 538 which relay is presently shown in the "relaxed" position with contact relay switch members 560 and 561 disposed in an upward position. Upon activation, switoh members 560 and 561 engage opposite contacts 562 and 563, respectively. The engagement of switch member 561 with contact 563 permits gear motor feed line 564 to be connected to relay connector wire 565 which is connected to switch member 566 of relay 539 that is directly connected to node 567. Node 567 is directly coupled to the 24 volt DC power line 568 extending from the connector 507 and power line 569 of control console 504. In this position, power relay 538 thus activates gear motor 52 through power line 564. Power line 564 is shown to extend through connector 502 to local mechanical relay power disconnect microswitch 510 (to be described below) where power is then coupled to gear motor 52 through line 570.

As described above, the circuit is thus completed in this first operational direction, and gear motor 52 is caused to rotate in a first direction for closing the cell door 12. It may be seen that the direction of the current flow is controlled by the direction relay 539, which, as described above, permits relay switch element 566 to become part of the circuit path from the power relay 538 causing gear motor 52 to rotate in a first direction. Likewise, with maintained contact switch 532 of control panel 504 placed in the open position, current is permitted to flow through open limit switch 526, bringing power through node 542 on the right side of diode 542A Diode 542A permits current to flow into power relay 538, while it prevents power from flowing into direction relay 539 when node 541 receives power through the close limit switch 524. With power received through node 542, the relay 538 is again actuated as described above. At this time, however, relay 539 is also activated wherein switch members 566 and 571 are then caused to move downwardly from the "relaxed" position shown to engage contact point 572A and 572, respectively. In the activited position, the relay 539 reverses the direction of flow of current from power supply 533 to the gear motor 52. As described above, switch member 561 of relay 538 engages contact point 563 to therein cause power line 564 to become connected to the ground circuit 573. At this point, power is permitted to flow through switch member 572 of relay 539 and therein through jumper 574 to contact point 562 of relay 538. Switch member 560 of relay 538 then permits the flow of current through line 575 to gear motor 52 in a direction reverse to that described above.

As shown in FIG. 12, an MOV 540 is provided in conjunction with a 1.5 ohm resistor 576 adjacent relay 538 for additional operational features. The resistor 576 provides a dynamic brake to the motor 52. With the relay 538 in the relaxed position shown, the terminals of the motor 52 are shorted out to the resistor 576. The motor 52 is a permanent magnet motor and the shorting of the motor leads acts like a dynamic brake. If the motor turns a voltage is generated, which shorted voltage tends to stop the motor from rotating. Likewise the MOV squelches any high voltage pulses. Voltage is generated by the collapse of the magnetic field in the gear motor 52 when the power to it is turned off. By utilization of the MOV 540, as shown, burning of the contacts of the relays 538 and 539 is substantially reduced.

In operation, the control panel 504 supplies power to the control circuit 500 disposed at each door 12 and activates the power relay 538, either independently or in conjunction with the directional relay 539. In this manner, the direction of rotation of gear motor 52 is directly controlled. The duration of drive of motor 52 is of course controlled by the close and open limit switches 524 and 526, respectively. In addition, the control system 500 further includes a timing circuit which adds a second level of control to the duration of operation of gear motor 52. The key element in the timer circuit is a mono stable timer chip 580 connected to the grounding circuit 573. The grounding circuit 573 is connected to the power relay 538 through mode 581. The power relay 538 must actuate every time the door 12 is moved either into an open or into a closed position. Power to the monostable timer chip 580 is effected through node 545 which is connected through pins 2 and 4 of said chip. Pin 3 of chip 580 is an output post and the length of the output pulse is determined by variable resistors associated with chip 580. Variable resistor 551 and capacitor 552, for example, determine the length of the output pulse from pin 3. The output pulse is separated from the rest of circuit 500 by an optoisolater 582. The optoisolater 582 prevents any static or RFI from coming back into the timer chip 580. The optoisolater 582 drives a transistor 583 (2N2222) in a sinking arrangement so that whenever post 3 comes on from chip 580, it turns on transistor 583 which acts like a switch and provides a ground for the command going into power relay 538. When the timer 580 times out, it opens up and removes the ground from relay 538. At that point, the power relay 538 is deactivated and the switching elements 560 and 561 thus reset to the relaxed setting shown herein, in which position the gear motor 52 is loaded across the resistor 576 as described above. Zener diode 584 provides power for the timing chip 580 while capacitor 552 serves as a filter for the output of said chip.

In a further description of the operation of the system, it is presented that a cell door, such as the type shown in FIG. 1A, on the order of 3 feet wide could take on the order of 5 seconds to traverse such a distance for opening or closing. In such a configuration, the monostable timer chip 580 could be set for approximately 10 seconds, which is about twice the length of a conventional jail cell opening or closing phase. In this way, if a jail detainee held the door momentarily but did ultimately get out of the way, the door would continue its movement to either open or close. If, however, the detainee blocked the door 12 beyond 10 seconds, said door would not then move again until the maintained contact switch 532 was reactivated to generate another command signal. In that event, however, the door position microswitch 522 would cause the appropriate LED 530 or 531 of the control panel 504 to activate to indicate on the control panel the "open" or "close" position of said door. In the case of a plurality of doors such as shown in FIG. 11, a plurality of LED displays can provide a visual signal while additional audible alarm means (not shown) may also be utilized in accordance with the principles of the present invention.

Referring still to FIG. 12, an additional aspect of the system 10 is the manual override of the control system 500. A local mechanical release power disconnect is shown in microswitch 510. The mechanical disconnect has been described relative to FIG. 1A wherein manual drive system 59 is actuated by a handle 590 disposed adjacent the transom of the cell door 12. The mechanical actuation of handle 590 causes a disengagement of the local mechanical release power disconnect (microswitch 510) to prevent the gear motor 52 from being inadvertently actuated during the manual engagement of the drive shaft 54. Without the safety device of microswitch 510, actuation of gear motor 52 could cause rotation of shaft 54 and thus the mechanical linkage leading to handle 59, possibly imparting serious injury to the user.

It is thus believed that the operation and construction of the present invention will be apparent from the foregoing description. While the method and apparatus shown or described has been characterized as being preferred it will be obvious that various changes and modifications may be made therein without departing from the spirit and scope of the invention as defined in the following claims.

I claim:

1. An improved detention cell looking system of the type utilizing a detention cell door having an upper supporting drive carriage for the movement thereof and mechanical linkage for locking said cell door in both the open and closed positions, said drive carriage being actuated by an electric drive assembly and imparting locking actuation to at least one vertical locking bar and a second carriage locking member, the improvement comprising first and second toggle plates mounted to said drive carriage and adapted for pivotal engagement one with the other and lost motion actuation in association therewith for both locking and unlocking said first mechanical linkage and said vertical locking bar.

2. The apparatus as set forth in claim 1 wherein said means for controlling the movement of said vertical locking bar includes first and second cam levers disposed on opposite ends of said carriage track, said cam levers being connected by a shaft having a rectilinear cam region therein, said vertical locking bar being coupled to said rectilinear cam region by a cam follower and wherein said levers are adapted for engaging said drive carriage in the vicinity of said large and small toggle plates for the actuation thereof in association with lost motion thereof.

3. The apparatus as set forth in claim 1 wherein said first toggle plate is constructed with a drive slot in the upper region thereof, said drive slot receiving said second toggle plate therein in pivotal engagement therewith, and wherein said first and second toggle plates are pivotally mounted to said drive carriage plate.

4. The apparatus as set forth in claim 1 wherein said mechanical linkage includes lifting elements coupled to locking arms for securing said cell door and said first toggle plate is constructed with oppositely disposed, first and second windows therein, said windows receiving said lifting elements therein for controlling said locking arms.

5. The apparatus as set forth in claim 4 wherein said lifting elements extend from said locking arms pivotally mounted to said drive carriage in a position engaging locking brackets in association with said cell door.

6. The apparatus as set forth in claim 1 wherein said electric drive assembly incorporates an electric drive motor secured above said cell door, a relatively smooth cylindrical drive shaft extending therefrom and adapted for rotation relative thereto and a drive block mounted to said drive shaft, said drive block being constructed with a plurality of bearings facilitating rectilinear motion of said drive block in response to rotation of said drive shaft.

7. The apparatus as set forth in claim 6 wherein said drive carriage is secured to said drive block and translates above said cell door in response to said rotation of said drive shaft.

8. The apparatus as set forth in claim 1 wherein said electric drive assembly comprises a drive motor and a timer circuit coupled in series to said motor and at least one door position sensor for controlling the duration of operation of said motor and movement of said cell door.

9. The apparatus as set forth in claim 8 wherein said electric drive assembly includes a first door position sensor detecting the open position of said cell door and a second door position sensor detecting the closed position of said cell door.

10. The apparatus as set forth in claim 8 wherein said electric drive assembly includes first and second actuation relays coupled to said drive motor and to said timer circuit for controlling the power to and the direction of operation of, said drive motor.

11. The apparatus as set forth in claim 10 and further including a resistor connected by said first relay to a position electrically shorting said motor and forming a dynamic brake therefor when said first relay is in a first position.

12. The apparatus as set forth in claim 11 and further including said first relay adapted for disconnecting said dynamic braking resistor upon actuation thereof and said second relay controlling the direction of flow of electric current through said first relay and said motor.

13. The apparatus as set forth in claim 8 wherein said electric drive assembly includes a control panel comprising a maintained centact switch coupled in series to said at least one door position sensor.

14. The apparatus as set forth in claim 13 wherein said control panel includes actuatable indicia indicating the open and closed position of said cell door.

15. An improved method of locking and unlocking detention cells of the type wherein a cell door is suspended from a supporting carriage with mechanical linkage for the movement thereof between locked and unlocked positions, said carriage being actuated by an electric drive assembly imparting locking actuation to at least one vertical locking bar and a second carriage locking member, the improvement comprising the steps of:

providing first and second toggle plates adapted for pivotal actuation one with the other;

mounting said toggle plates within said carriage assembly in position for pivotal engagement with said mechanical linkage disposed relative to said cell door for the locking and unlocking thereof.

16. The method as set forth in claim 15 wherein said carriage assembly includes a carriage plate and said step of mounting said toggle plates to said carriage assembly includes a step of pivotally mounting said first toggle plate to said carriage plate with said second toggle plate in pivotal engagement therewith and moving said toggle plate in response to said electric drive assembly for generating lost motion actuation of said first and second toggle plates.

17. The method as set forth in claim 15 and further including the step of providing a vertical locking bar responsive to horizontal movement of mechanical linkage responsive to said movement of said carriage assembly.

18. The method as set forth in claim 15 and further including the step of providing said toggle plate with a drive slot in the upper region thereof, receiving said second toggle plate within said drive slot in pivotal engagement therewith, and pivotally mounting said first and second toggle plates to said drive carriage plate.

19. The method as set forth in claim 15 and further including the step of providing said mechanical linkage with lifting elements coupled to locking arms for securing said cell door, forming said first toggle plate with oppositely disposed windows therein, and receiving said lifting elements within said windows for controlling said looking arms.

20. The method as set forth in claim 19 and further including the step of extending said lifting elements from said locking arms into a position engaging locking brackets provided in association with said cell door.

21. The method as set forth in claim 15 and further including the step of providing said electric drive assembly with an electric drive motor, securing said drive motor above said cell door, providing a relatively smooth cylindrical drive shaft, mounting said shaft relative to said motor and extending said shaft therefrom for rotation relative thereto, providing a drive block, mounting said drive block to said shaft for rectilinear motion of in response to rotation of said drive shaft.

22. The method as set forth in claim 5 and further including the steps of providing said electric drive assembly with a door position sensor, a drive motor and a timer circuit, coupling said circuit in series to said motor and to said door position sensor for controlling the duration of operation of said motor and movement of said cell door.

23. The method as set forth in claim 22 and further including the step of providing said electric drive assembly with a first door position sensor detecting the open position of said cell door and a second door position sensor detecting the closed position of said cell door.

24. The method as set forth in claim 22 and further including the step of providing said electric drive assembly with first and second actuation relays, coupling said relays to said drive motor and to said timer circuit, and controlling the power to, and the direction of operation of, said drive motor.

25. The method as set forth in claim 24 and further including the step of providing a resistor, connecting said resistor to said first relay in a position shorting said motor and forming a dynamic brake therefor when said first relay is in a first position.

26. The apparatus as set forth in claim 25 and further including the steps of setting said first relay to disconnect said dynamic brake resistor upon actuation thereof and setting said second relay to control the direction of flow of electric current through said first relay and said motor.

* * * * *

UNITED STATES PATENT AND TRADEMARK OFFICE

CERTIFICATE OF CORRECTION

PATENT NO. : 5,299,385

DATED : April 5, 1994

INVENTOR(S) : Lloyd McConnell

It is certified that error appears in the above-indentified patent and that said Letters Patent is hereby corrected as shown below:

Column 1, line 39: Delete "looking"; insert --locking--

Column 1, line 40: Insert a period after --door--

Column 1, line 66: Delete "looking"; insert --locking--

Column 2, line 4: Delete "look"; insert --lock--

Column 2, line 16: Delete "look"; insert --lock--

Column 2, line 25: Insert a period after --frame--

Column 2, line 26: Delete "looking"; insert --locking--

Column 2, line 49: Insert a period after --systems--

Column 3, line 4: Delete "looking"; insert --locking--

Column 3, line 53: Delete "looked"; insert --locked--

Column 4, line 12: Delete "613 6"; insert -- 6-6 --

Column 4, line 37: Delete "Looking" insert --Locking--

Column 5, line 48: Insert a period after --moving--

Column 6, line 3: Insert a period after --82--

Column 6, line 13: Delete "looking"; insert --locking--

Column 6, line 62: Delete "out-out"; insert --cut-out--

Column 9, line 55: Insert a period after --therethrough--

Column 9, line 56: Insert a period after --thereover--

Column 12, line 41: Delete "5"; insert --56--

UNITED STATES PATENT AND TRADEMARK OFFICE

CERTIFICATE OF CORRECTION

PATENT NO. : 5,299,385

DATED : April 5, 1994

INVENTOR(S) : Lloyd McConnell

It is certified that error appears in the above-indentified patent and that said Letters Patent is hereby corrected as shown below:

Column 13, line 6: Insert a period after --52B--

Column 13, line 54: Delete "switoh"; insert --switch--

Column 14, line 13: Insert a period after --542A--

Column 16, line 1: Delete "looking"; insert --locking--

Column 18, line 23: Delete "5"; insert --15--

Signed and Sealed this

Tenth Day of January, 1995

*Attest:*

Bruce Lehman

BRUCE LEHMAN

*Attesting Officer*

*Commissioner of Patents and Trademarks*